US010679788B2

(12) United States Patent
Hsieh et al.

(10) Patent No.: US 10,679,788 B2
(45) Date of Patent: Jun. 9, 2020

(54) METHOD OF MANUFACTURING MAGNETIC CORE ELEMENTS

(71) Applicant: CYNTEC CO., LTD., Hsinchu (TW)

(72) Inventors: Hsieh-Shen Hsieh, Hsinchu (TW); Shih-Feng Chien, Hsinchu (TW); Yu-Lun Chang, Hsinchu (TW); Chih-Hung Wei, Hsinchu (TW)

(73) Assignee: CYNTEC CO., LTD., Hsinchu (TW)

( * ) Notice: Subject to any disclaimer, the term of this patent is extended or adjusted under 35 U.S.C. 154(b) by 0 days.

(21) Appl. No.: 16/153,811

(22) Filed: Oct. 7, 2018

(65) Prior Publication Data

US 2019/0051453 A1 Feb. 14, 2019

Related U.S. Application Data

(62) Division of application No. 14/746,854, filed on Jun. 23, 2015, now Pat. No. 10,121,585.

(60) Provisional application No. 62/015,535, filed on Jun. 23, 2014.

(51) Int. Cl.

| | |
|---|---|
| ***H01F 41/02*** | (2006.01) |
| ***H01F 27/24*** | (2006.01) |
| ***H01F 27/245*** | (2006.01) |

(52) U.S. Cl.

CPC ..... *H01F 41/0233* (2013.01); *H01F 27/24* (2013.01); *H01F 27/245* (2013.01); *Y10T 156/1052* (2015.01)

(58) Field of Classification Search

CPC .... H01F 41/0233; H01F 27/24; H01F 27/245; Y10T 156/1052

See application file for complete search history.

(56) References Cited

U.S. PATENT DOCUMENTS

| | | | | |
|---|---|---|---|---|
| 2,664,541 | A * | 12/1953 | Henderson | H05B 41/10 315/239 |
| 3,444,732 | A | 5/1969 | Robbins | |
| 3,826,701 | A | 7/1974 | Miller | |
| 3,880,603 | A | 4/1975 | Whetsone | |
| 3,925,139 | A | 12/1975 | Simmons | |
| 5,783,026 | A | 7/1998 | Natarajan | |
| 6,031,341 | A | 2/2000 | Yoshizawa | |
| 7,295,092 | B2 | 11/2007 | Elliott | |
| 2002/0132136 | A1 | 9/2002 | Roshen | |

(Continued)

FOREIGN PATENT DOCUMENTS

| | | | |
|---|---|---|---|
| CN | 1591715 | A | 3/2005 |
| CN | 1263052 | C | 7/2006 |

(Continued)

*Primary Examiner* — Mark A Osele

*Assistant Examiner* — Christopher C Caillouet

(74) *Attorney, Agent, or Firm* — Winston Hsu

(57) ABSTRACT

A method of manufacturing magnetic core elements includes preparing a plurality of magnetic green sheets and a plurality of non-magnetic green sheets; along a laminating direction, alternately laminating the plurality of magnetic green sheets and non-magnetic green sheets, thereby forming a green sheet laminate; along the laminating direction, cutting the green sheet laminate into a plurality of bodies with desired dimension; and sintering each of the bodies, thereby forming a plurality of magnetic core elements respectively having a plurality of discretely distributed gaps formed by the non-magnetic green sheets.

23 Claims, 9 Drawing Sheets

(56) References Cited

U.S. PATENT DOCUMENTS

| | | | |
|---|---|---|---|
| 2005/0003079 | A1 | 1/2005 | Wakayama |
| 2005/0045268 | A1 | 3/2005 | Yoshida |
| 2005/0151613 | A1 | 7/2005 | Takaya |
| 2006/0192646 | A1 | 8/2006 | Hanley |
| 2009/0280338 | A1 | 11/2009 | Christian |
| 2012/0299680 | A1 | 11/2012 | Zajc |

FOREIGN PATENT DOCUMENTS

| | | | |
|---|---|---|---|
| CN | 101438358 | A | 5/2009 |
| CN | 101657868 | A | 2/2010 |
| JP | S56-81917 | | 7/1981 |
| JP | 7-66076 | | 3/1995 |
| TW | I236685 | | 7/2005 |
| TW | 200741765 | | 11/2007 |
| TW | I312521 | | 7/2009 |
| WO | 2010/109272 | A2 | 9/2010 |

* cited by examiner

METHOD OF MANUFACTURING MAGNETIC CORE ELEMENTS

CROSS REFERENCE TO RELATED APPLICATIONS

This application is a division of U.S. application Ser. No. 14/746, 854 filed Jun. 23, 2015, and now issued as patent U.S. Pat. No. 10,121,585, which claims priority from U.S. provisional application No. 62/015,535, filed Jun. 23, 2014. The above-mentioned applications are included in their entirety herein by reference.

BACKGROUND OF THE INVENTION

1. Field of the Invention

This invention relates generally to manufacture of magnetic components, and more specifically to manufacturing of a magnetic core element with discretely distributed gaps.

2. Description of the Related Art

As known in the art, magnetic components such as inductors or transformers include at least one winding disposed about a magnetic core. Typically, a core assembly is fabricated from ferrite cores that are gapped and bonded together.

The magnetic core is subject to energy loss during operation. By including a gap in the magnetic core, the saturation current can be increased and the inductance of the magnetic device can be adjusted. However, magnetic flux may distribute outside the gap and influence the winding that surrounds the core, leading to extra energy loss and inductance shift.

One approach to solving this problem is dividing a relatively large gap into a plurality of discretely distributed gaps over the length of the magnetic core. By using the discretely distributed gaps, the magnetic flux does not influence the winding that surrounds the core. Further, the direction of the magnetic flux may be parallel with the winding, resulting in less loss.

However, it is difficult to form a miniaturized magnetic core with many discretely distributed gaps, which require parallel gaps with highly uniform gap width. Therefore, there is a need in this industry to provide an improved method for fabricating a magnetic core with discretely distributed gaps with reduced and uniform gap width.

SUMMARY OF THE INVENTION

It is one object of the invention to provide an improved fabrication method of miniaturized core elements for magnetic components such as power inductors and transformers.

In one aspect, one embodiment of the present invention provides a method of manufacturing magnetic core elements including preparing a plurality of magnetic green sheets and a plurality of non-magnetic green sheets; alternately laminating the plurality of magnetic green sheets and non-magnetic green sheets directly upon one another, thereby forming a green sheet laminate; cutting the green sheet laminate into individual bodies with desired dimension; and sintering the individual bodies, thereby forming a magnetic core element with discretely distributed gaps.

According to another embodiment, a method of manufacturing magnetic core elements includes preparing a plurality of magnetic green sheets; preparing a plurality of support intermediate paste pattern embedded with an ashable pattern therein; alternately laminating the plurality of magnetic green sheets and the plurality of support intermediate paste pattern embedded with an ashable pattern directly upon one another, thereby forming a laminate; subjecting the laminate to a sintering process, wherein the ashable patterns that are interposed between the magnetic green sheets are burned out during the sintering process, thereby forming cavities in the laminate; filling the cavities with an adhesive; and cutting the laminate into individual bodies with desired dimension.

According to another embodiment, a method of manufacturing magnetic core elements includes preparing a plurality of magnetic sheets; preparing a plurality of spacer sheets; alternately laminating the plurality of magnetic sheets and the plurality of spacer sheets directly upon one another, thereby forming a laminate; subjecting the laminate to a curing process; and cutting the laminate into discrete core elements with desired dimension.

According to another embodiment, a method of manufacturing magnetic core elements includes preparing a capping magnetic piece; preparing a plurality of lower magnetic pieces, wherein each of the lower magnetic pieces has at least two upwardly protruding side legs; laminating the lower magnetic pieces and the capping magnetic piece, thereby forming a plurality of cavities therebetween; filling the cavities with an adhesive, thereby forming a laminate; subjecting the laminate to a curing process; and cutting the laminate into discrete core elements with desired dimension and configuration.

According to still another embodiment, a method of manufacturing magnetic core elements includes preparing a monolithic magnetic body; performing a diamond wire sawing process to form a plurality of trenches with high-aspect ratio and uniform trench width into a top surface of the magnetic body, wherein the trenches separate a plurality of sidewall pieces from one another, wherein the plurality of sidewall pieces are connected together by a bottom connecting portion; filling the trenches with an adhesive; and performing a polishing process to remove the bottom connecting portion, thereby forming a magnetic core element.

These and other objectives of the present invention will no doubt become obvious to those of ordinary skill in the art after reading the following detailed description of the preferred embodiment that is illustrated in the various figures and drawings.

DETAILED DESCRIPTION

In the following description, numerous specific details are given to provide a thorough understanding of the invention. It will, however, be apparent to one skilled in the art that the invention may be practiced without these specific details. Furthermore, some well-known system configurations and process steps are not disclosed in detail, as these should be well-known to those skilled in the art. Therefore, the scope of the invention is not limited by the following embodiments and examples.

First Embodiment

Figure 1:
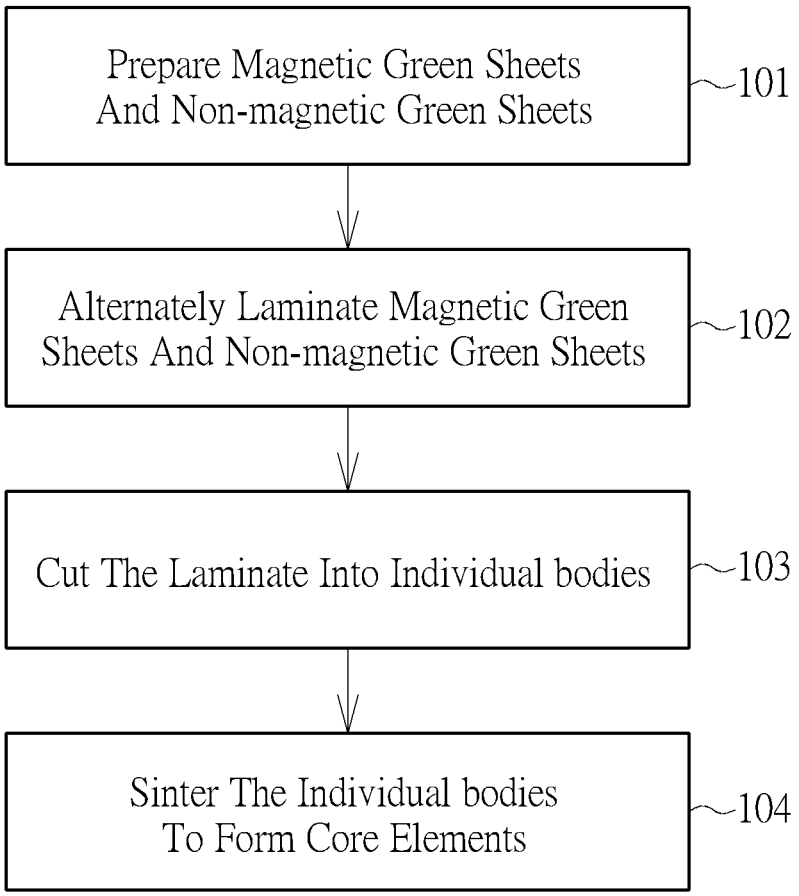
FIG. 1 is a flowchart showing a method of manufacturing magnetic core elements with discretely distributed gaps according to one embodiment of the invention.

FIG. 1 is a flowchart showing a method of manufacturing magnetic core (e.g. I-core) elements with discretely distributed gaps according to one embodiment of the invention.

It is to be understood that the magnetic core elements fabricated according to the invention may be used in the fields of chokes, transformers, inductors, or common-mode inductors, but not limited thereto. For example, the fabricated magnetic core element according to the invention may function as an I-core that may be mated with a U-core piece or an E-core piece.

As shown in FIG. 1, first, a plurality of magnetic green sheets and a plurality of non-magnetic green sheets are prepared (STEP 101). The term "green sheet" as referred to in the present invention is a sheet prior to a firing/co-firing treatment or a sintering process. The term "air-gapping" is used herein even if the gap of the magnetic core is filled not by air but by some non-magnetic material preventing from magnetic saturation.

According to the first embodiment of the invention, each of the magnetic green sheets may comprise known ferrite having high magnetic permeability, low core loss, and high application frequency. For example, each of the magnetic green sheets may comprise Mn—Zn or Ni—Zn.

According to the first embodiment of the invention, each of the non-magnetic green sheets may comprise non-magnetic metal oxides with relatively lower magnetic permeability, for example, $ZrO_2$, but not limited thereto. $ZrO_2$ is a relatively stable metal oxide during a co-firing process.

According to the first embodiment of the invention, $ZrO_2$ is not reduced during the co-firing process. It is to be understood that other non-magnetic materials with high chemical and dimensional stability, as well as a shrinkage rate matching the magnetic green sheets may be used.

According to the first embodiment of the invention, each of the non-magnetic green sheets acts as a spacer or air-gapping layer interposed between two adjacent magnetic green sheets to separate the two adjacent magnetic green sheets from each other with a substantially fixed gap distance across its main surface.

According to the first embodiment of the invention, each of the non-magnetic green sheets has a uniform thickness across its entire surface. According to the first embodiment of the invention, for example, each of the non-magnetic green sheets has a uniform thickness ranging between 0.01-0.7 mm.

Subsequently, the plurality of magnetic green sheets and non-magnetic green sheets are alternately laminated directly upon one another under a hydraulic pressure (5000-8000 psi), thereby forming a green sheet laminate (STEP 102). According to the first embodiment of the invention, the magnetic green sheets and non-magnetic green sheets are preferably laminated under a hot-press pressure of about 200-500 kg/cm$^2$ and temperature between 70-90° C., for example, 300 kg/cm$^2$ and 80° C., but not limited thereto.

Figure 2:
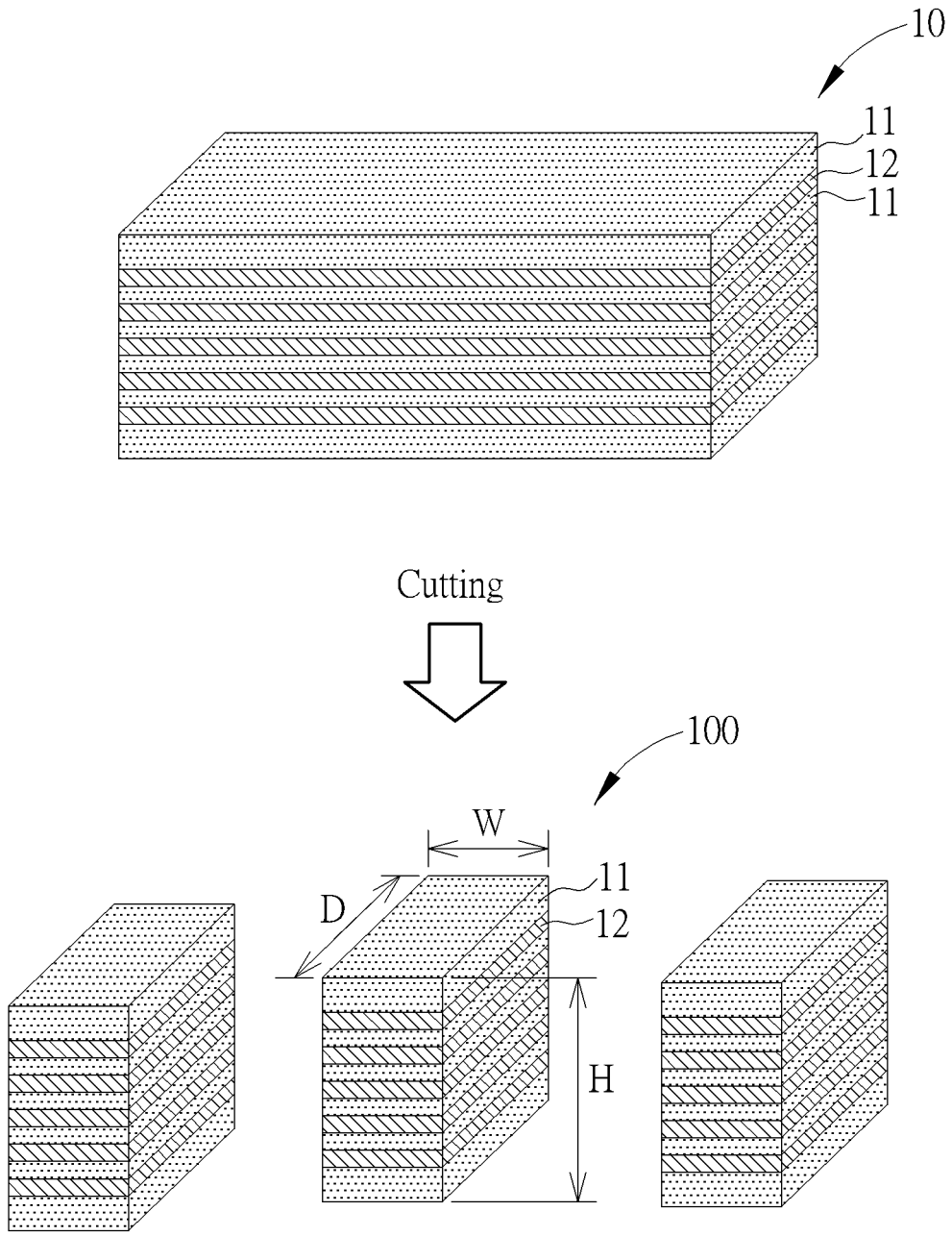
FIG. 2 includes perspective views illustrating the cutting process of the green sheet laminate and the exemplary dimension of each of the individual bodies.

After the lamination of the green sheets, the green sheet laminate is then cut into individual bodies with desired dimension and configuration (STEP 103). FIG. 2 includes perspective views illustrating the cutting process of the green sheet laminate and the exemplary dimension of each of the individual bodies. As shown in FIG. 2, the green sheet laminate 10 includes a plurality of magnetic green sheets 11 and non-magnetic green sheets 12. The green sheet laminate 10 is then cut into individual bodies 100 with desired dimension. For example, each of the individual bodies 100 has a dimension of 11.8 mm (H)×16 mm (D)×3-4 mm (W).

For example, the aforesaid cutting process may be performed by using a cutting blade, a wire saw, a water blade, a laser blade, sandblasting, or the like. Further, after the cutting process, the two opposite cut sides of each of the individual bodies may be subjected to a polishing process to form smooth surfaces.

The individual bodies cut from the green sheet laminate are sintered in $H_2/N_2$ mixed atmosphere at 1200-1300° C. for Mn—Zn and in air at 1100-1300° C. for Ni—Zn (STEP 104), thereby forming the magnetic core element with discretely distributed gaps. By performing cutting process (Step 103) first, the possibility of cracking of the core product can be reduced. However, it is understood that in some cases, the aforesaid sintering process (or co-firing) of the laminate may be performed prior to the cutting process.

Preparation of Green Sheets

The preparation of the above-described magnetic green sheets and non-magnetic green sheets will be explained below in greater detail by using an example thereof.

To prepare the magnetic green sheet, ferrite materials comprising 40-60 mol % of $Fe_2O_3$, 30-40 mol % of MnO, and 10-20 mol % of ZnO are dispersed in a solvent by a ball mill for a predetermined dispersing time, thereby forming a slurry. The solvent may include, but not limited to, toluene, ethanol, or their mixtures.

A dispersant or a dispersing agent, for example, polycarboxylates, polyphosphonates, or poly ammonium salts, having 0.5~3% by weight of the ferrite material, may be added. Preferably, the dispersing time may be more than 2 hours. An average particle diameter D50 may be less than 1.5 micrometers. D50 represents the median particle size of the value of the particle diameter at 50% in the cumulative distribution.

After dispersing and ball milling of the ferrite materials, a binder and a plasticizer are added into the slurry, and the slurry is then ball-milled preferably for more than 6 hours.

Preferably, the binder may include, but not limited to, polyvinyl alcohol, polyvinyl butyral, polyacrylic acid ester, polymethyl methacrylate, ethyl cellulose, or polymethacrylic acid ester, and may have 3-10% by weight of the ferrite material.

Preferably, the plasticizer may include, but not limited to, dibutyl phthalate, butyl phthalyl butyl glycolate, poly ethylene glycol, or butyl stearate, and may have 20-50% by weight of the binder additive.

The formed slurry is then sprayed onto a release film, for example, a release film comprising polyethylene terephthalate (PET), and then dried at 80-120° C. in a hot air drying apparatus to form a uniform magnetic green sheet with a substantially fixed thickness in a range of tens to thousands of micrometers. For example, the aforesaid drying process may be performed at three successive stages: 80° C., 100° C., and 120° C. After drying, the magnetic green sheet is peeled off from the release film.

To prepare the non-magnetic green sheet, an air-gapping oxide material such as $ZrO_2$ is dispersed in a solvent by a ball mill for a predetermined dispersing time, thereby forming a slurry. The solvent may include, but not limited to, toluene, ethanol, or their mixtures. A dispersant or a dispersing agent, for example, polycarboxylates, polyphosphonates, or poly ammonium salts, having 3-5% by weight of the air-gapping oxide material, may be added. Preferably, the dispersing time may be more than 2 hours.

After dispersing and ball milling of the air-gapping oxide material, a binder and a plasticizer are added into the slurry, and the slurry is then ball-milled preferably for more than 6 hours. Preferably, the binder may include, but not limited to, polyvinyl alcohol, polyvinyl butyral, polyacrylic acid ester, polymethyl methacrylate, ethyl cellulose, or polymethacrylic acid ester, and may have 3-10% by weight of the air-gapping oxide material. Preferably, the plasticizer may include, but not limited to, dibutyl phthalate, butyl butylphthallylglycolate, poly ethylene glycol, or butyl stearate, and may have 20-50% by weight of the binder additive. The solid content of magnetic material to the combination of solvent, dispersant, binder, and plasticizer ranges between 70:30 and 50:50 (before drying). After drying, no solvent is contained.

The formed slurry is then sprayed onto a release film, for example, a release film comprising PET, and then dried at 80-120° C. in a hot air drying apparatus to form a uniform non-magnetic green sheet with a substantially fixed thickness in a range of tens to hundreds of micrometers. Likewise, the aforesaid drying process may be performed at three successive stages: 80° C., 100° C., and 120° C.

After drying, the non-magnetic green sheet is peeled off from the release film. Subsequently, the formed magnetic green sheets and the non-magnetic green sheets are alternately laminated directly upon one another according to process flow as described in FIG. 1.

Second Embodiment

Figure 3:
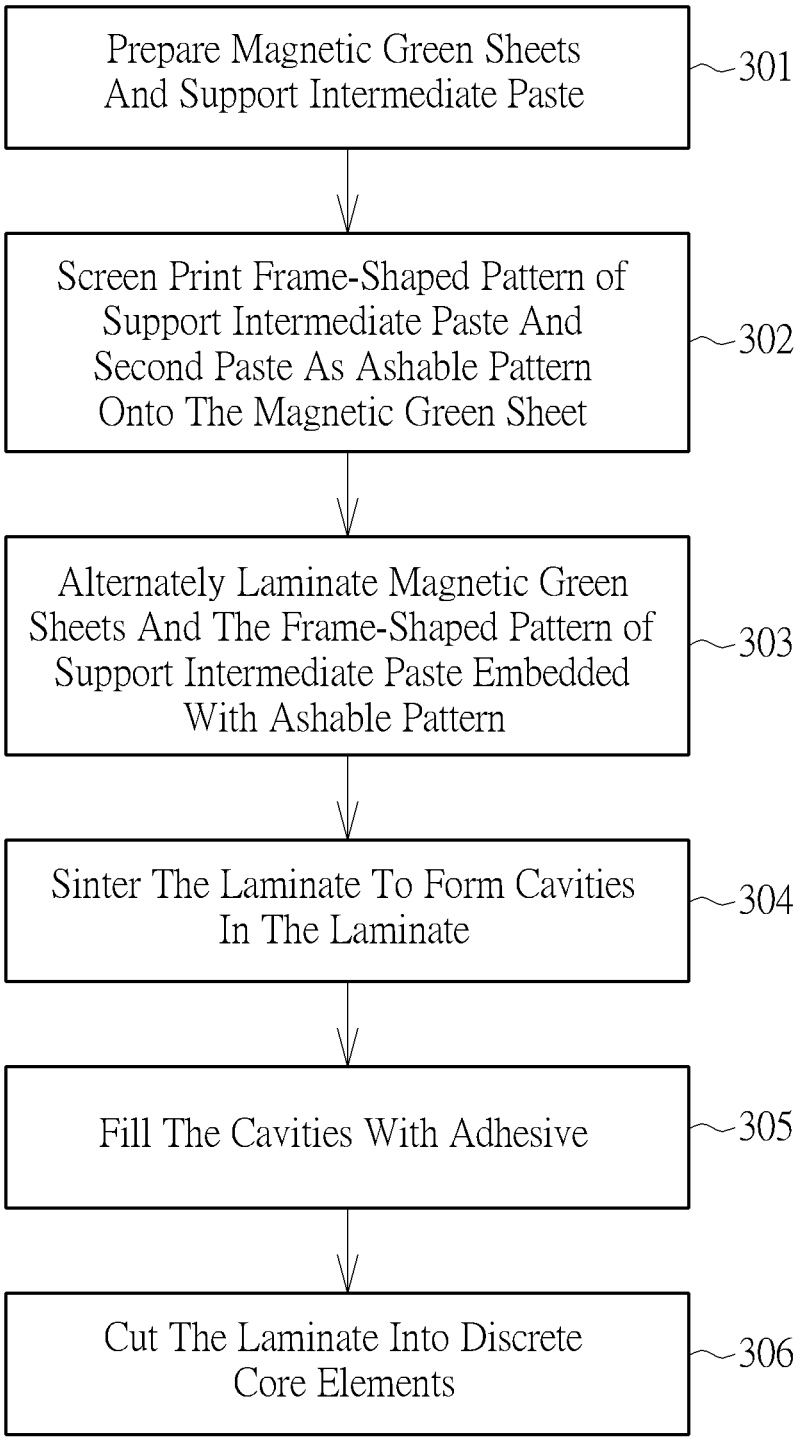
FIG. 3 is a flowchart showing a method of manufacturing magnetic core elements with discretely distributed gaps according to the second embodiment of the invention.

FIG. 3 is a flowchart showing a method of manufacturing magnetic core (e.g. I-core) elements with discretely distributed gaps according to the second embodiment of the invention. As shown in FIG. 3, in STEP 301, a plurality of magnetic green sheets may be prepared according to the disclosed preparation steps alluded to above.

According to the second embodiment of the invention, each of the magnetic green sheets may comprise known ferrite having high magnetic permeability, low core loss, and high application frequency. The formed magnetic sheet has a magnetic permeability of about 1000~3000 that is greater than the magnetic permeability of the gap (about 1~10). For example, each of the magnetic green sheets may comprise Mn—Zn or Ni—Zn.

A support intermediate paste is prepared. According to the second embodiment of the invention, the support intermediate paste may have the same composition as that of the magnetic green sheets. By using the same composition, defects such as cracking during subsequent firing process can be reduced and the gap thickness can be reduced and can be precisely controlled. However, it is understood that the support intermediate paste and the magnetic green sheets may have different compositions in some embodiments.

According to the second embodiment of the invention, each of the support intermediate paste may have a frame-shaped pattern with an opening. The opening extends through an entire thickness of the support intermediate paste. The opening may be formed by methods known in the art, for example, printing, cutting, routing, punching, or the like.

For example, a support intermediate paste composed of the same composition as that of magnetic green sheet, and second paste that may be composed of only binder and plasticizer, without ferrite, are prepared. In some embodiments, the second paste may further comprise an ashable material, such as carbon. Preferably, the binder may include, but not limited to, polyvinyl alcohol, polyvinyl butyral, polyacrylic acid ester, polymethyl methacrylate, ethyl cellulose, or polymethacrylic acid ester. Preferably, the plasticizer may include, but not limited to, dibutyl phthalate, butyl butylphthallylglycolate, poly ethylene glycol, or butyl stearate.

Subsequently, a printing process such as a screen printing process is performed to print a frame-shaped pattern of the support intermediate paste with a central opening on the magnetic green sheet. Then, the second paste that may have only binder and plasticizer is printed as ashable pattern into the central opening of each of the intermediate support green sheets (STEP 302).

According to the second embodiment of the invention, subsequently, the plurality of magnetic green sheets and the frame-shaped pattern of the support intermediate paste embedded with the ashable pattern are alternately laminated directly upon one another (STEP 303), thereby forming a laminate.

After the lamination of the green sheets, the laminate is sintered in $H_2/N_2$ mixed atmosphere at 1200-1300° C. for Mn—Zn and in air at 1100-1300° C. for Ni–Zn (STEP 304). During the sintering process, the ashable patterns of pure binder and plasticizer that are interposed between the magnetic green sheets are burned out, thereby forming cavities in the laminate, which are the spaces originally occupied by the ashable patterns.

At this point, the frame-shaped pattern of the support intermediate paste acts as connecting parts between adjacent magnetic green sheets, which maintain the structural integrity of the laminate with cavities.

According to the second embodiment of the invention, subsequently, the cavities are filled with an adhesive (STEP 305). The laminate with the cavities that are filled with the adhesive is then thermally treated by a curing process or a baking process to cure the adhesive.

After the curing process, the laminate is then cut into individual bodies with desired dimension and configuration (STEP 306). Subsequently, optionally, a polishing process may be performed to polish the intermediate support paste away to thereby form discrete core elements with smooth and polished surfaces. According to the second embodiment of the invention, after polishing, the magnetic green sheets are separated from one another by the adhesive and are not in direct contact to each other.

Figure 4:
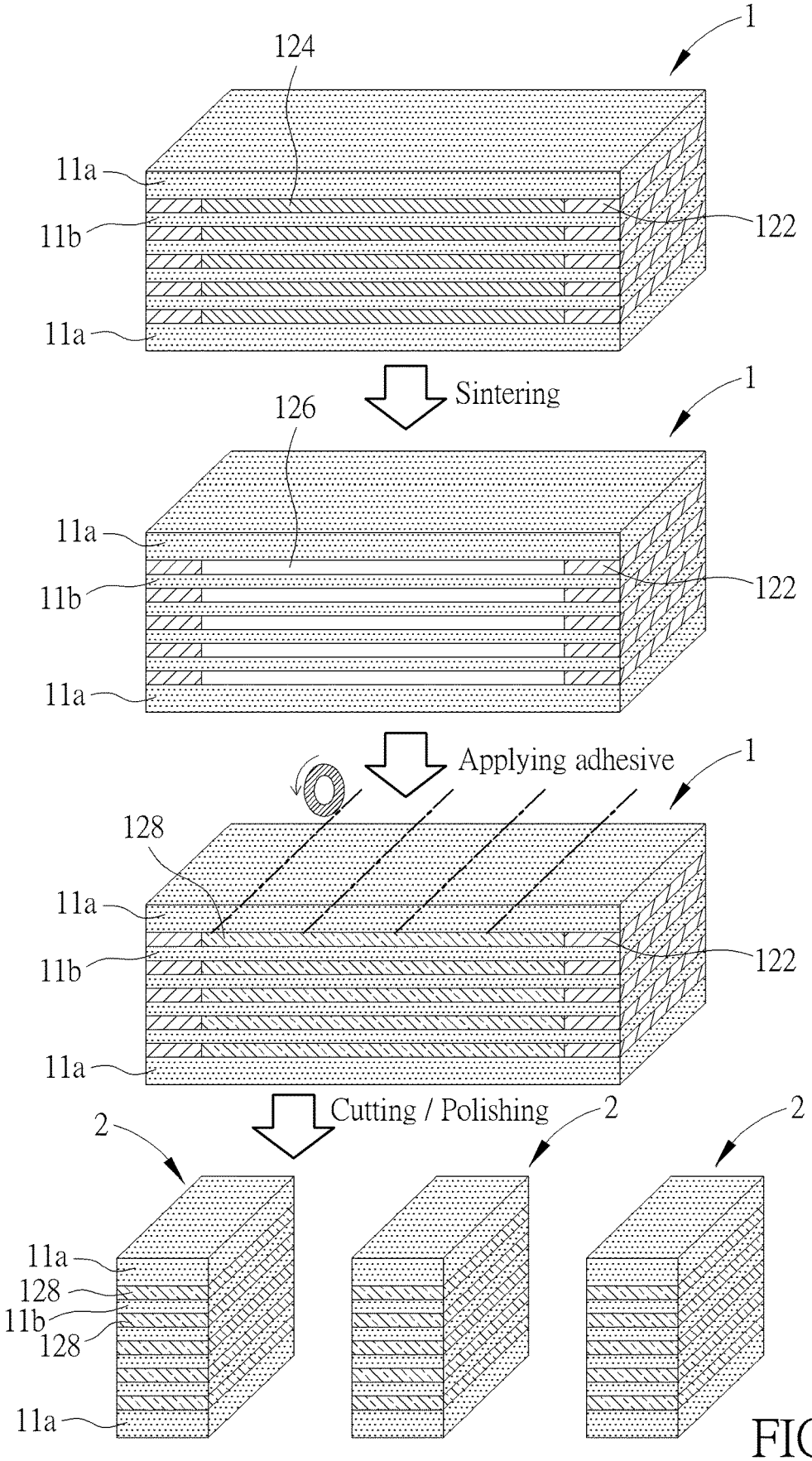
FIG. 4 includes perspective views of the laminate and discrete core elements fabricated by STEP 303 to STEP 306 as set forth in FIG. 3.

FIG. 4 includes perspective views of the laminate and discrete core elements fabricated by STEP 303 to STEP 306 as set forth in FIG. 3. As shown in FIG. 4, the laminate 1 is formed by alternately laminating a plurality of magnetic green sheets 11*a* and 11*b* with both frame-shaped patterns 122 and ashable patterns 124 on them. The outer magnetic green sheets 11*a* (the topmost and the bottom ones) may have a greater thickness than that of the inner magnetic green sheets 11*b*. The ashable pattern 124 may be composed of carbon or carbon-based materials, but not limited thereto. The ashable pattern 124 may be removed at high temperatures.

The laminate 1 is subjected to a sintering process. During the sintering process, the ashable patterns 124 that are interposed between the magnetic green sheets 11*a* and 11*b* are burned out, thereby forming cavities 126 in the laminate 1, which are the spaces originally occupied by the ashable patterns 124. After the ashable patterns 124 are removed, the frame-shaped pattern 122 acts as a connecting part between two adjacent magnetic green sheets 11*a*/11*b*, which maintain the structural integrity of the laminate 1 with cavities 126.

Subsequently, the cavities 126 are filled with an adhesive 128. The laminate 1 with the cavities 126 that are filled with the adhesive 128 is then thermally treated by a curing process or a baking process to cure the adhesive 128. After the curing process, the laminate 1 is then cut into individual bodies with desired dimension and configuration. A polishing process is then performed to polish the frame-shaped pattern 122 away to thereby form discrete core elements 2 with smooth and polished surfaces.

Third Embodiment

Figure 5:
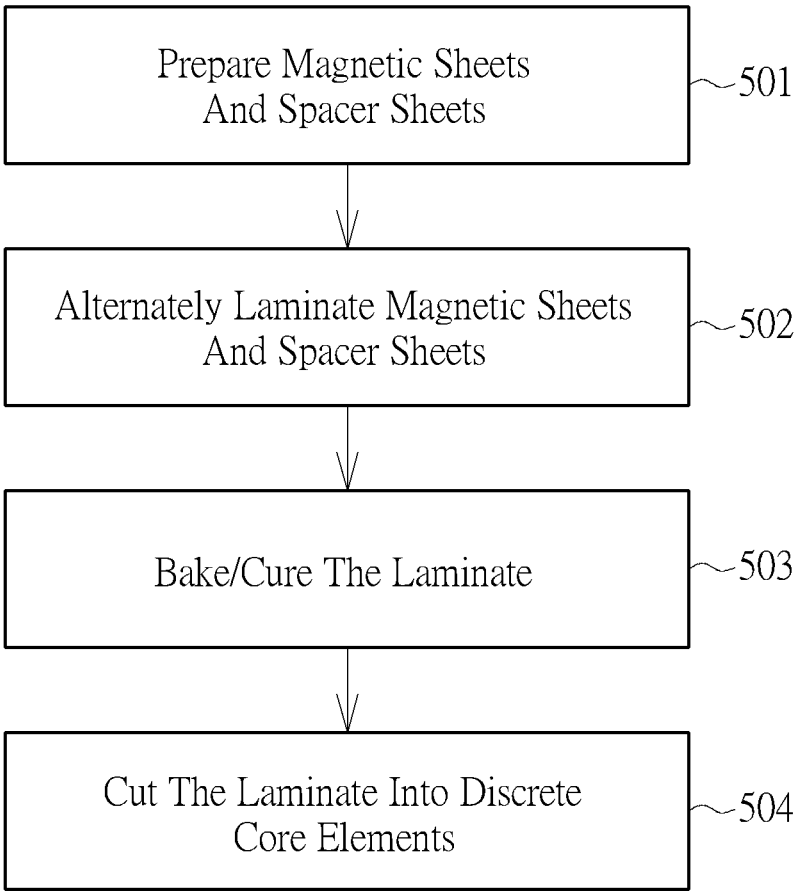
FIG. 5 is a flowchart showing a method of manufacturing magnetic core elements with discretely distributed gaps according to the third embodiment of the invention.

FIG. 5 is a flowchart showing a method of manufacturing magnetic core (I-core) elements with discretely distributed gaps according to the third embodiment of the invention.

First, in STEP 501, magnetic sheets are prepared. According to the third embodiment of the invention, each of the magnetic sheets may comprise known ferrite having high magnetic permeability, low core loss, and high application frequency. For example, each of the magnetic sheets may comprise Mn—Zn or Ni—Zn.

Subsequently, the plurality of magnetic sheets and a plurality of spacer (or air-gapping) sheets are alternately laminated directly upon one another, thereby forming a laminate (STEP 502). It is to be understood that the magnetic sheets are already treated by sintering process before the lamination process.

According to the third embodiment of the invention, each of the spacer sheets may comprise a dry film of prepreg. Prepreg may comprise glass fiber and resin. Prepreg may be directly bonded and formed using a hot pressing method. By adjusting the heating temperature, pressing pressure, time, the spacing between the magnetic sheets can be controlled. According to this embodiment, glass beads, tin balls, or cylinders are not required when using prepreg.

According to the third embodiment of the invention, each of the spacer sheets has a uniform thickness across its entire surface. According to the third embodiment of the invention, for example, each of the spacer sheets has a uniform thickness ranging between 0.01-0.7 mm. The thickness of each of the spacer sheets defines the gap width (h) of each of the distributed gaps in the core element.

After the lamination of the magnetic sheets and spacer sheets, the laminate is subjected to a baking or curing process (STEP 503). Thereafter, optionally, a thermal pressing process is performed, such that the magnetic sheets are tightly bonded together by the intervening spacer sheets.

Subsequently, in STEP 504, the laminate is cut into discrete core elements with desired dimension and configuration. For example, each of the discrete core elements has a dimension of 11.8 mm (H)×16 mm (D)×3-4 mm (W). By using the fabrication method described in FIG. 5, each of the discrete core elements may have a width (W) that is greater than twice of the gap width (W/h>2). For example, the aforesaid cutting process may be performed by using a cutting blade, a wire saw, a water blade, a laser blade, sandblasting, or the like. The spacer sheets form discretely distributed gaps in each of the discrete core elements.

Figure 6:
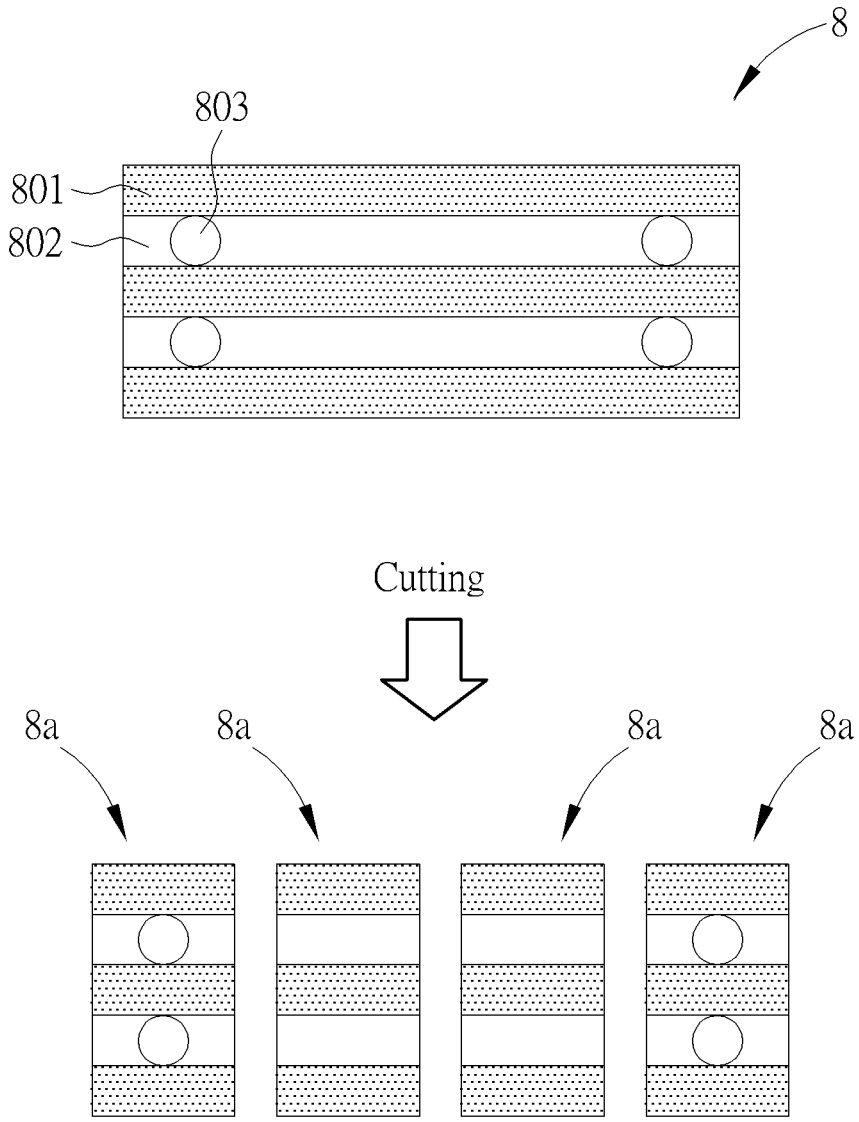
FIG. 6 shows an exemplary method of fabricating the core elements using adhesive layers and spacers dispersed in the adhesive layers.

Alternatively, each the spacer sheet may be composed of an adhesive that is blended with spacers such as glass beads, tin balls, or cylinders, but not limited thereto. For example, the adhesive blended with spacers may be screen-printed onto the magnetic sheets in a layer-by-layer manner. As shown in FIG. 6, a laminate 8 composed of magnetic sheets 801 and adhesive layers 802 are formed. The spacers 803 such as glass beads, tin balls, or cylinders are disposed in the adhesive layers 802. In some embodiments, each of the adhesive layers 802 maybe applied onto the magnetic sheet first, and then the spacers 803 are disposed in the adhesive layers 802. After curing, the laminate 8 is cut into discrete core elements with desired dimension and configuration.

Fourth Embodiment

Figure 7:
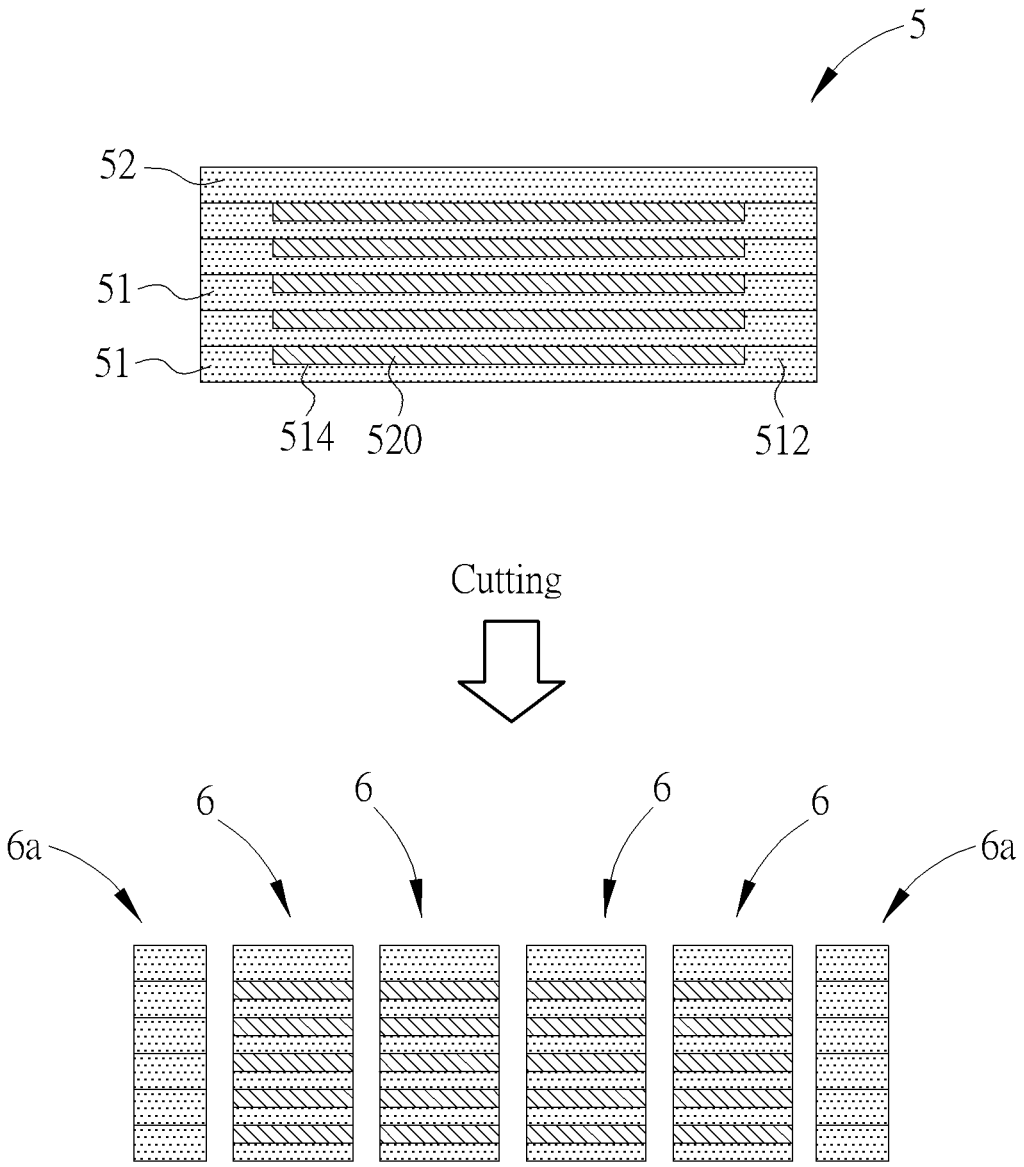
FIG. 7 shows an exemplary method of fabricating the core elements according to a fourth embodiment.

FIG. 7 shows an exemplary method of fabricating the core elements according to a fourth embodiment.

As shown in FIG. 7, lower magnetic pieces 51 and a capping magnetic piece 52 are prepared. Each of the lower magnetic pieces 51 has at least two upwardly protruding legs 512(for example side leg) such that after laminating the lower magnetic sheets 51 and the capping magnetic piece 52, a plurality of cavities 514 are formed therebetween. The cavities 514 are filled with adhesive 520. The laminate 5 is then subjected to a curing process to cure the adhesive 520. The laminate 5 is then cut into discrete core elements 6 with desired dimension and configuration. The side leg stack 6*a* is separated from the discrete core elements 6 by the cutting process.

It is to be understood that the shape of the magnetic pieces 51 in FIG. 7 is for illustration purposes only. Other shapes of the magnetic pieces 51, for example, E-shape with three upwardly protruding legs, may be employed.

Fifth Embodiment

Figure 8:
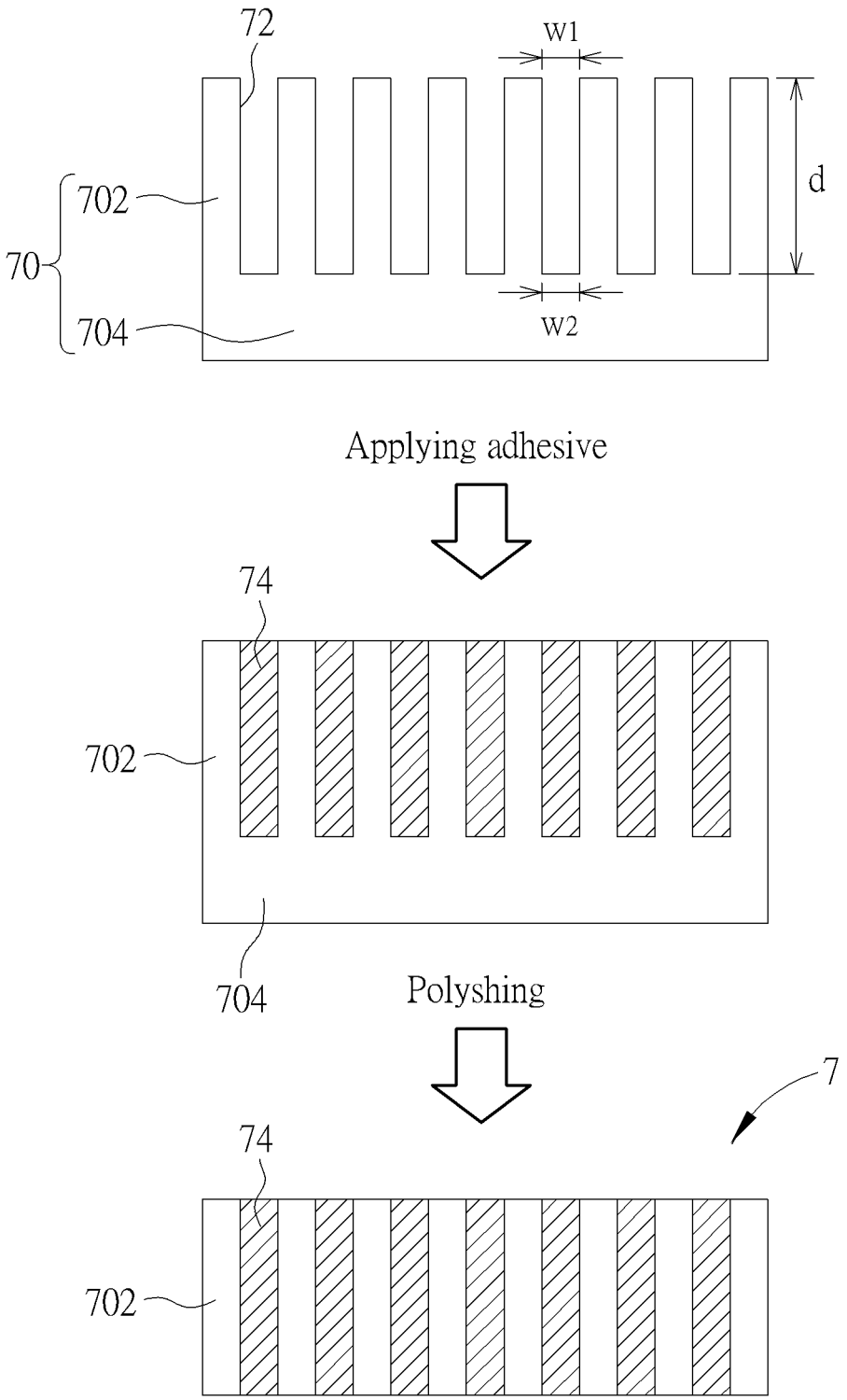
FIG. 8 shows schematic, sectional views of an exemplary method of fabricating magnetic core elements according to the fourth embodiment of the invention.

FIG. 8 shows schematic, sectional views of an exemplary method of fabricating magnetic core elements according to the fifth embodiment of the invention. As shown in FIG. 8, a monolithic magnetic body 70 is prepared. The magnetic body 70 is already treated by sintering process. The magnetic body 70 may comprise known ferrite having high magnetic permeability, low core loss, and high application frequency. For example, each of the magnetic sheets may comprise Mn—Zn or Ni—Zn.

According to the fifth embodiment of the invention, the magnetic body 70 is subjected to a diamond wire sawing process to form a plurality of trenches 72 with high-aspect ratio between 4-2000 and uniform trench width into a top surface of the magnetic body 70. For example, each of the trenches 72 has substantially the same trench top width $w_1$ and trench bottom width $w_2$.

According to the fifth embodiment of the invention, the width of each of the trenches 72 depends upon the diameter of the diamond wire used in the diamond wire sawing process. For example, the diamond wire used in the diamond wire sawing process may have a diameter of about 0.14 mm, but not limited thereto. The trenches 72 may have substantially the same trench depth d, for example, trench depth d ranges between 1-160 mm.

The trenches 72 separate a plurality of sidewall pieces 702 from one another. The plurality of sidewall pieces 702 are connected together by a bottom connecting portion 704. Subsequently, the trenches 72 are filled up with an adhesive 74. The adhesive 74 is then cured. The magnetic body 70 is subjected to a polishing process or a cutting process to remove the bottom connecting portion 704, thereby forming a magnetic core element 7.

Figure 9:
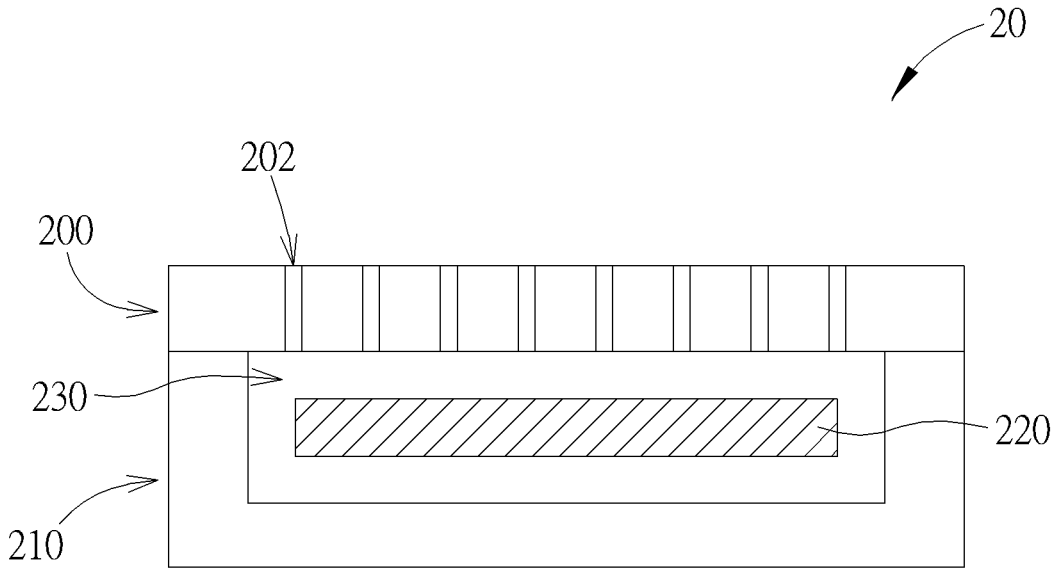
FIG. 9 is a schematic, cross-sectional diagram showing an exemplary magnetic component according to the invention.

FIG. 9 is a schematic, cross-sectional diagram showing an exemplary magnetic component according to the invention. As shown in FIG. 9, the exemplary magnetic component 20 comprises an I-core 200 coupled to a U-core piece 210. The I-core 200 may be connected to the U-core piece 210 by using an adhesive, but not limited thereto. A cavity 230 is defined between the I-core 200 and the U-core piece 210. A coil, winding, or conductor 220 is disposed in the cavity 230. The I-core 200 may be fabricated by methods described hereinabove. The I-core 200 comprises distributed gaps 202. In some embodiments, the I-core 200 may be coupled to an E-core piece or an H-core piece, but not limited thereto.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of manufacturing a magnetic component, comprising:

preparing a plurality of magnetic green sheets and a plurality of non-magnetic green sheets;

along a laminating direction, alternately laminating the plurality of magnetic green sheets and non-magnetic green sheets, thereby forming a green sheet laminate;

along the laminating direction, cutting the green sheet laminate into a plurality of bodies with desired dimension;

sintering the bodies, thereby forming a plurality of first magnetic core elements respectively having a plurality of discretely distributed gaps formed by the non-magnetic green sheets; and connecting each of the first magnetic core elements to a second magnetic core element thereby forming a magnetic path surrounding a conductor, wherein the magnetic path has the plurality of discretely distributed gaps, wherein the magnetic component has magnetic field lines passing through the first magnetic core element along the magnetic path and along the laminating direction.

2. The method according to claim 1, wherein each of the magnetic green sheets comprises Mn—Zn or Ni—Zn.

3. The method according to claim 1, wherein each of the non-magnetic green sheets comprises a non-magnetic metal oxide.

4. The method according to claim 3, wherein the non-magnetic metal oxide comprises $ZrO_2$.

5. The method according to claim 1, wherein each of the non-magnetic green sheets acts as a spacer or air-gapping layer interposed between adjacent two of the magnetic green sheets to separate the adjacent two of the magnetic green sheets from each other with a substantially fixed gap distance across its main surface.

6. The method according to claim 1, wherein each of the non-magnetic green sheets has a uniform thickness across its entire surface.

7. The method according to claim 1, wherein each of the non-magnetic green sheets in each of the first magnetic core elements has a thickness ranging between 0.01-0.7 mm to form the plurality of discretely distributed gaps.

8. The method according to claim 1, wherein the plurality of magnetic green sheets and non-magnetic green sheets are alternately laminated directly upon one another under a hydraulic pressure.

9. The method according to claim 8, wherein the hydraulic pressure ranges between 5000-8000 psi.

10. The method according to claim 1, wherein cutting the green sheet laminate comprises using a cutting blade, a wire saw, a water blade, a laser blade, or sandblasting.

11. The method according to claim 1, wherein each of the bodies has two opposite cut sides that are parallel with each other and parallel with the laminating direction and an I-shaped cross-sectional surface between the two opposite cut sides, wherein both of the two opposite cut sides and the I-shaped cross-sectional surface expose each of magnetic green sheets and each of the non-magnetic green sheets, wherein the I-shaped cross-sectional surface has two longer sides respectively on the two opposite cut sides and two shorter sides between the two opposite cut sides, wherein the longer sides has a length larger than a length of the two shorter sides.

12. The method according to claim 1 further comprising: polishing the two opposite cut sides of each of the bodies to form two smooth surfaces of each of the bodies.

13. The method according to claim 1, wherein each of the bodies cut from the green sheet laminate is sintered at 1100-1300° C.

14. The method according to claim 1, wherein the non-magnetic green sheets have a magnetic permeability smaller than a magnetic permeability of the magnetic green sheets.

15. The method according to claim 1, wherein the non-magnetic green sheets have a magnetic permeability between 1-10, and the magnetic green sheets have a magnetic permeability between 1000-3000.

16. The method according to claim 1, wherein the first magnetic core elements respectively have magnetic field lines passing through the plurality of discretely distributed gaps thereof along the lamination direction.

17. The method according to claim 1, wherein the magnetic green sheets and the non-magnetic green sheets are individually prepared before being laminated.

18. The method according to claim 1, wherein each of the magnetic green sheets comprise particles having an average diameter (D50) less than 1.5 micrometers.

19. A magnetic component, comprising:

a first core element comprising a plurality of magnetic layers and a plurality of non-magnetic layers formed by alternately laminating a plurality of magnetic green sheets and a plurality of non-magnetic green sheets along a laminating direction to form a laminate and then sintering the laminate, wherein the first core element has a surface parallel with the laminating direction and exposing each of the magnetic layers and each of the non-magnetic layers, wherein the non-magnetic layers form a plurality of discretely distributed gaps of the first core element;

a conductor disposed adjacent to one side of the first core element and spaced apart from the first core element by a space; and a second core element connected to the first core element to form a magnetic path surrounding the conductor, wherein the magnetic path has the plurality of discretely distributed gaps, wherein the magnetic component has magnetic field lines passing through the first core element along the magnetic path and along the laminating direction.

20. The magnetic component according to claim 19, wherein the first core element has an I-shaped cross-sectional surface along the laminating direction, wherein the I-shaped cross-sectional surface has a longer side along the surface and a shorter side perpendicular to the surface, wherein a length of the longer side is larger than a length of the shorter side.

21. The magnetic component according to claim 19, wherein each of the non-magnetic layers comprises a non-magnetic metal oxide having a magnetic permeability lower than a magnetic permeability of the magnetic layers.

22. The magnetic component according to claim 19, wherein the second core element has an E-shaped cross-sectional surface, a H-shaped cross-sectional surface or a U-shaped cross-sectional surface.

23. The magnetic component according to claim 19, wherein at least a portion of a diffusion magnetic flux outside the non-magnetic layers of the magnetic component is parallel with the conductor.

* * * * *